US010687644B1

(12) United States Patent
Moore et al.

(10) Patent No.: US 10,687,644 B1
(45) Date of Patent: Jun. 23, 2020

(54) CUP HOLDER ADAPTER FOR MUG

(71) Applicants: Bruce W. Moore, Midlothian, TX (US); Tammy L. Moore, Midlothian, TX (US)

(72) Inventors: Bruce W. Moore, Midlothian, TX (US); Tammy L. Moore, Midlothian, TX (US)

( * ) Notice: Subject to any disclaimer, the term of this patent is extended or adjusted under 35 U.S.C. 154(b) by 0 days.

(21) Appl. No.: 16/517,277

(22) Filed: Jul. 19, 2019

(51) Int. Cl.

| | |
|---|---|
| ***F21V 21/00*** | (2006.01) |
| ***A47G 23/02*** | (2006.01) |
| ***G09F 23/00*** | (2006.01) |
| ***F21V 33/00*** | (2006.01) |
| *F21S 4/00* | (2016.01) |
| *F21Y 115/10* | (2016.01) |
| *F21Y 113/13* | (2016.01) |
| *F21V 5/04* | (2006.01) |
| *F21V 7/00* | (2006.01) |

(52) U.S. Cl.
CPC ..... *A47G 23/0216* (2013.01); *A47G 23/0233* (2013.01); *F21V 33/0004* (2013.01); *G09F 23/00* (2013.01); *A47G 2023/0283* (2013.01); *A47G 2200/08* (2013.01); *F21S 4/00* (2013.01); *F21V 5/04* (2013.01); *F21V 7/00* (2013.01); *F21Y 2113/13* (2016.08); *F21Y 2115/10* (2016.08)

(58) Field of Classification Search
CPC ..... A47G 23/0216; A47G 23/0233; A47G 2023/0283; A47G 2200/08; F21V 33/0004; F21V 5/04; F21V 7/00; G09F 23/00; F21Y 2113/13; F21Y 2115/10; F21S 4/00
USPC ..... 362/101, 96, 234, 488, 253
See application file for complete search history.

(56) References Cited

U.S. PATENT DOCUMENTS

| | | | | |
|---|---|---|---|---|
| 5,040,719 | A * | 8/1991 | Ballway | A47G 19/2205 215/10 |
| 5,285,953 | A * | 2/1994 | Smith | B60N 3/103 220/737 |
| 5,326,064 | A * | 7/1994 | Sapien | B60N 3/10 224/926 |
| 5,330,145 | A * | 7/1994 | Evans | B60N 3/103 224/547 |
| 5,676,340 | A * | 10/1997 | Ruhnau | B60N 3/103 248/311.2 |
| 5,782,448 | A * | 7/1998 | Withun | B60N 3/106 248/311.2 |
| 5,897,041 | A * | 4/1999 | Ney | B60N 3/101 224/483 |
| 6,092,905 | A * | 7/2000 | Koehn | A47G 23/0216 362/101 |
| 6,315,153 | B1 * | 11/2001 | Osborn | A47G 23/0216 220/737 |
| 8,061,670 | B1 * | 11/2011 | White | B60N 3/10 248/309.1 |
| 10,384,580 | B2 * | 8/2019 | Medina Luna | B60N 3/10 |
| 2008/0006643 | A1 * | 1/2008 | Ma | A47J 41/0011 220/592.16 |
| 2012/0097724 | A1 * | 4/2012 | Standfest | B60N 3/103 224/545 |

(Continued)

*Primary Examiner* — Laura K Tso
(74) *Attorney, Agent, or Firm* — James E. Walton

(57) ABSTRACT

An adapter for placing a mug into a traditional cup holder has a top section, a generally vertical slot in the top section configured to receive a handle of the mug, and a bottom section configured for inserting the adapter into the cup holder.

20 Claims, 4 Drawing Sheets

(56) References Cited

U.S. PATENT DOCUMENTS

| | | | | |
|---|---|---|---|---|
| 2016/0091244 | A1* | 3/2016 | Revelis | F25D 31/007<br>62/457.9 |
| 2016/0190838 | A1* | 6/2016 | Webb | B60N 3/10 |
| 2018/0220820 | A1* | 8/2018 | Shelton | A47G 23/0216 |

* cited by examiner

CUP HOLDER ADAPTER FOR MUG

BACKGROUND

1. Field of the Invention

The present invention relates in generally to cup holders.

2. Description of Related Art

Cup holders provide a place to secure cups and drinking glasses when not in use and are typically circular in shape. Cup holders can be found in a wide variety of devices used by people, including vehicles, lawn chairs, and furniture, particularly recliners, theater chairs, and home theater chairs and sofas. Because cup holders are generally circular is shape, they do not accommodate mugs, which typically have radially extending handles. Sometimes, a user may prefer to use a mug instead of a cup or glass, particularly when drinking hot liquids, such as coffee, tea, or hot chocolate. It is difficult to use cup holders with mugs, as the handles typically prevent the mug from being fully inserted into the cup holder. Placing a mug in a cup holder results in the mug being unbalanced or unlevel, leading to unwanted spills and messes.

Although great strides have been made in the area of cup holders, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
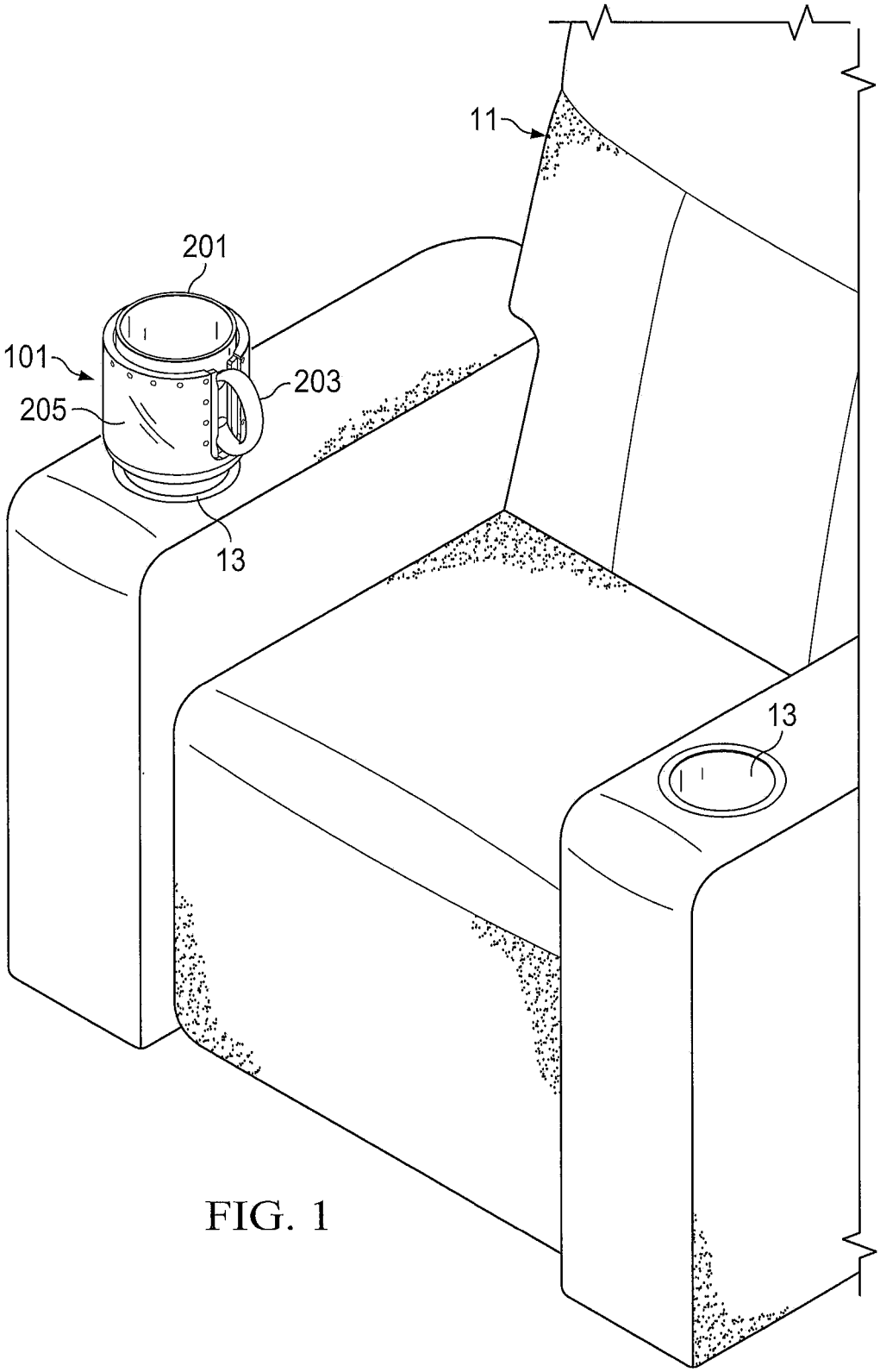
FIG. 1 is a perspective view of a cup holder adapter for a mug used with a chair according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, combinations, and alternatives falling within the spirit and scope of the present application as defined by the appended claims.

DETAILED DESCRIPTION OF THE PREFERRED EMBODIMENT

Illustrative embodiments of the cup holder adapter for a mug system are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIG. 1 in the drawings, the preferred embodiment of a cup holder adapter 101 for a mug 201 having a radially extending handle 203 according to the present application is illustrated. Adapter 101 is shown in use with a chair 11 having one or more cup holders 13. Adapter 101 can be placed into cup holder 13 to allow a user to continue using mug 201 while seated in chair 11. While chair 11 is depicted as a home theater chair, it should be understood that chair 11 is not limited to any particular type of chair or furniture. Indeed, cup holder 13 may be part of a wide variety of devices, including vehicles, lawn furniture, theater chairs, etc. Chair 11 should be understood to preferably include a seat within reach of at least one cup holder. For example, chair 11 could be a driver's seat in a vehicle and cup holder 13 could be a cup holder in the nearby console.

Figure 2:
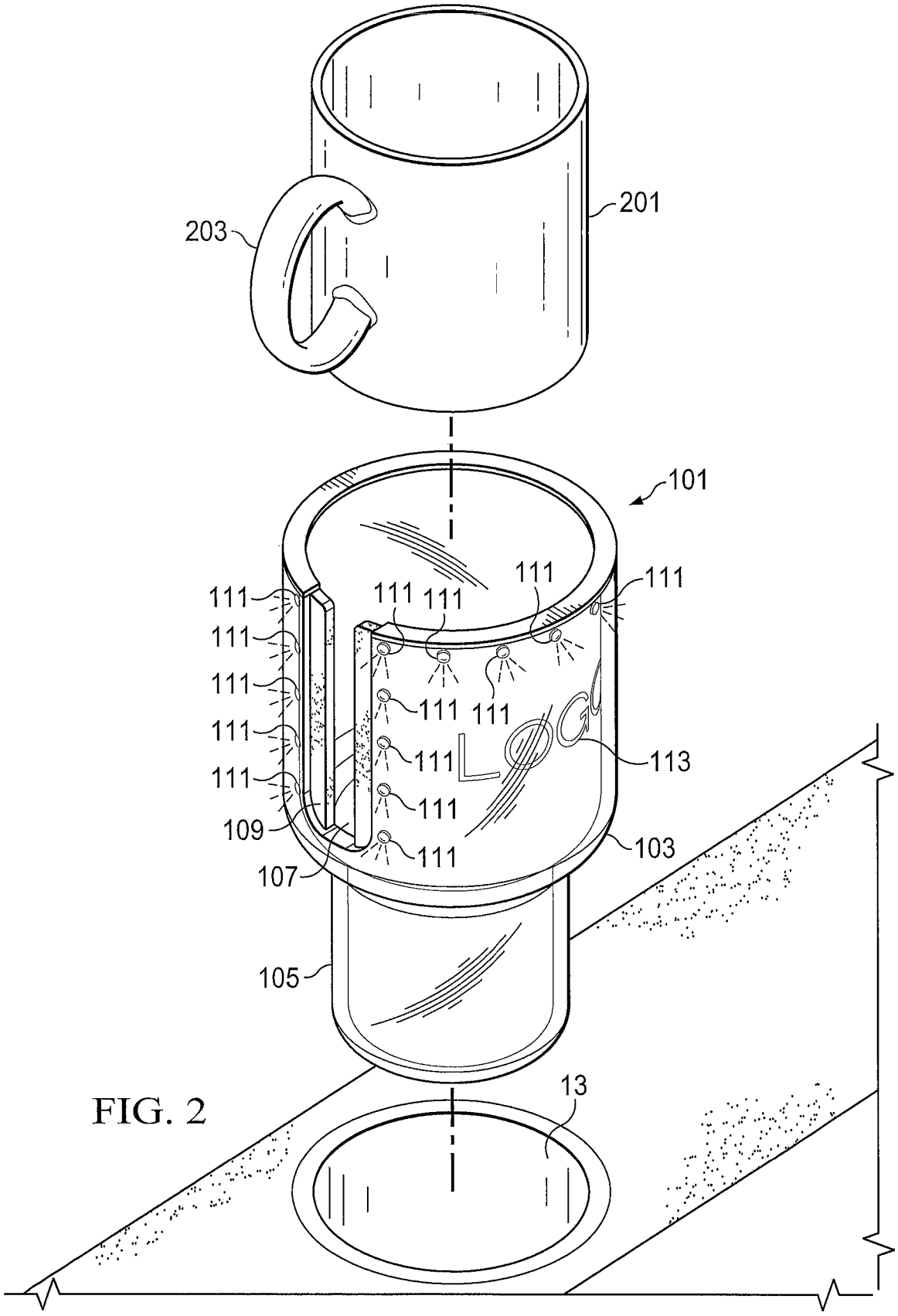
FIG. 2 is a perspective view of a cup holder adapter for a mug according to the present application.
Figure 4:
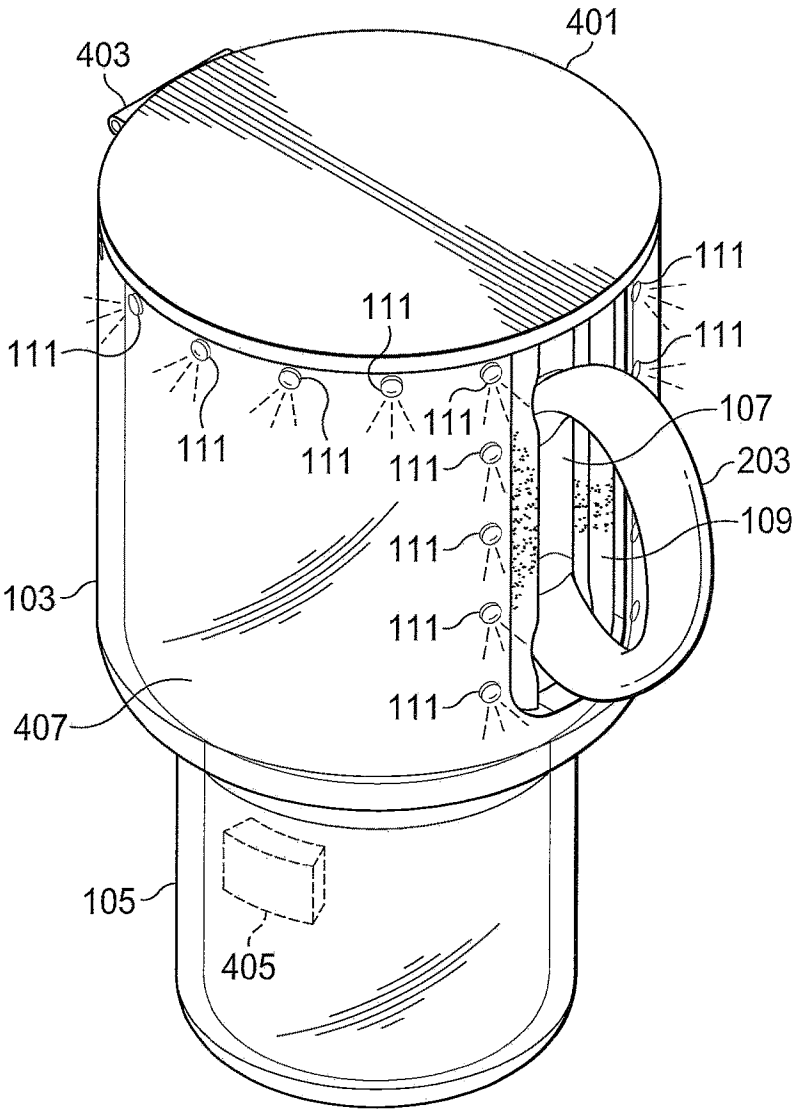
FIG. 4 is a perspective view of an alternative embodiment of a cup holder adapter for a mug according to the present application.

Referring now also to FIG. 2 in the drawings, cup holder 13, adapter 101, and mug 201 are shown in an exploded view. Adapter 101 generally comprises of a top section 103, a bottom section 105, a slot 107, and one or more inserts 109. As depicted, adapter 101 is shown to be of a double walled construction; however, it should be understood that adapter 101 is not limited to a particular type of construction or material. For example, adapter 101 could be of a solid 205 (as shown in FIG. 1), hollow 407 (as shown in FIG. 4), transparent or translucent construction, and may be made of plastic, stainless steel, or ceramic, foam rubber, or any other suitable material. In some embodiments, adapter 101 may include multiple construction types. For example, top section 103 can be of a double walled construction to provide additional insulation for mug 201 and bottom section 105 can be of a solid or hollow construction since additional insulation may not be required. In those embodiments in which adapter 101 has a transparent top section 103, any graphical indicia on mug 201 would be visible.

In the embodiments shown herein, top section 103 is configured to receive mug 201 with handle 203 and is generally larger in diameter than bottom section 105. To secure mug 201 in place, the user slides handle 203 into slot 107. Slot 107 accommodates handle 203 and allows mug 201 to remain level and balanced with adapter 101. Inserts 109 fit snuggly around handle 203, thereby assisting in securely holding mug 201. In the preferred embodiment, slot 107 is generally vertical. Insert 109 can be made of any material that allows for securing handle 203 into adapter 101, such as, for example, foam, rubber, or silicone. In addition, insert 109 may be comprised of a single piece or of multiple pieces, and can be in any shape, including a u-shape. In this embodiment, insert 109 contacts handle 203 of mug 201, but does not prevent mug 201 from being removed from adapter 101. Thus, when mug 201 is removed from adapter 101, adapter 101 is not removed from cup holder 13.

Top section 103 may also comprise one or more lighting elements 111 and/or one or more promotional graphical indicia or logos 113. As depicted, lighting elements 111 may be discrete lighting elements; however, it should be understood that lighting elements 111 may be in other forms, such as a single light, strip lights, or other arrangements or lighting elements. Lighting elements 111 are preferably LED lights, and may provide illumination in one or more modes, including backlit, front lit, and other forms. Lighting elements 111 may also include lens covers, reflectors, diffusers, and various types of decorative and/or aesthetic features. It will be appreciated that lighting elements may be a single color or may be multi-colored, and may include various switches, controllers, timers, sensors, programming, batteries, etc. to control the operation of lighting elements 111. For example, lighting elements 111 may be programmed to turn off once the user picks up mug 201 and/or adapter 101.

Promotional indicia or logo 113 may be stamped, printed, embossed, engraved, or otherwise disposed on or about adapter 101. Logo 113 may be a company logo, or the user may want to display a family graphic or photo on adapter 101. Logo 113 may also be a card or insert that fits between the walls of adapter 101. In such case, at least top section 103 would be transparent or translucent, so that logo 113 can be seen through the exterior wall of adapter 101, and logo 113 may be installed during construction of adapter or by the user via a slot or opening in adapter 101.

In the preferred embodiment, top section 103 has a larger diameter that bottom section 105; however, in some embodiments, to section 103 may be of the same size (as shown in FIG. 2) or smaller than bottom section 105. Such embodiments are particularly useful in situations where cup holder 13 is relatively large, and mug 201 is relatively small.

In some embodiments, bottom section 105 can be fitted with a heating element 405 to help keep the liquid in mug 201 warmer longer. The heating element in may be powered by a rechargeable battery pack within adapter 101 and may be removed for charging. Alternatively, bottom section 105 can be fitted with a cooling pack 503 to help keep the liquid in mug 201 cooler longer.

Figure 3:
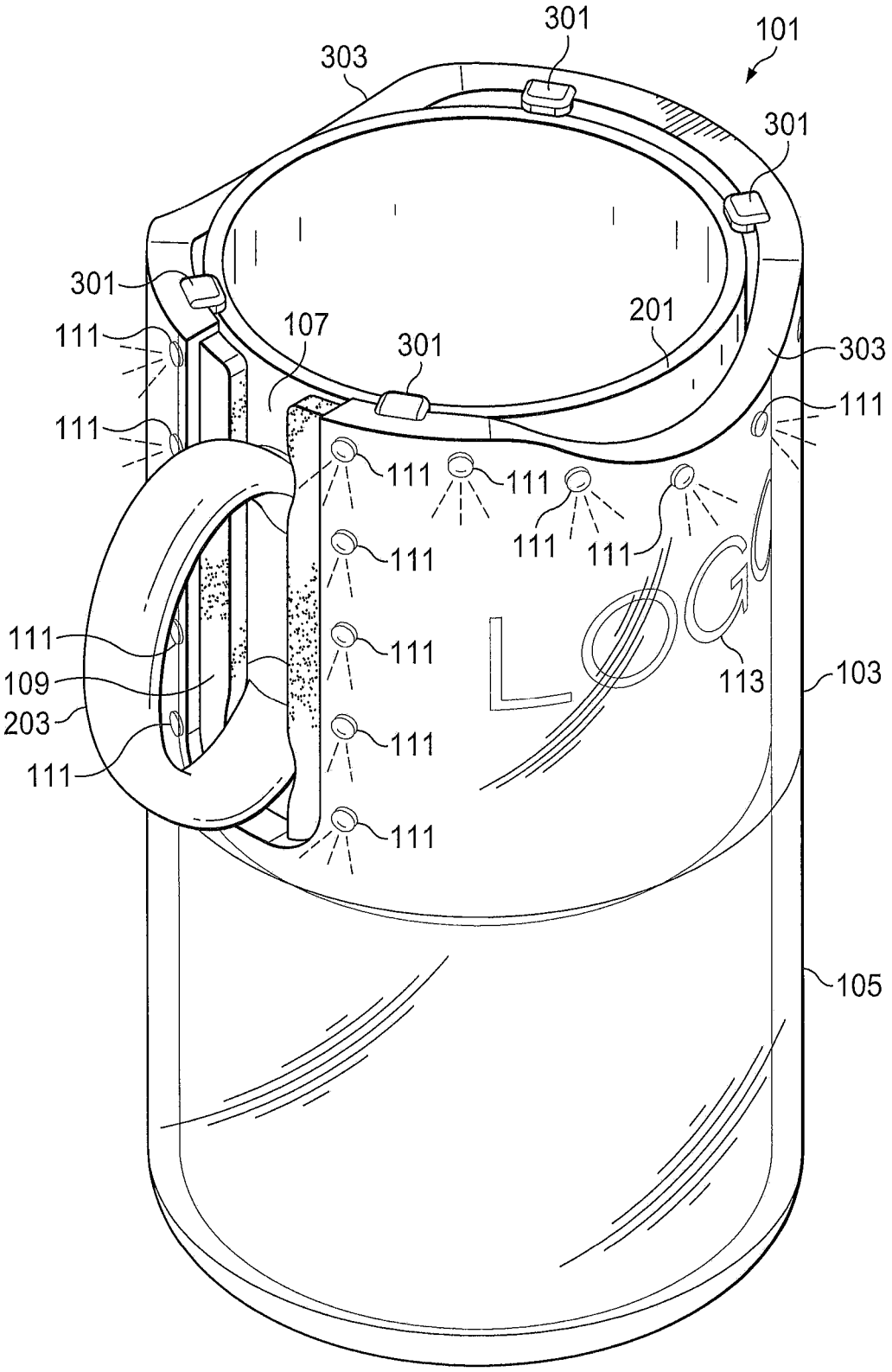
FIG. 3 is a perspective view of an alternative embodiment of a cup holder adapter for a mug according to the present application.

Referring now also to FIG. 3 in the drawings, an alternative embodiment of a cup holder adapter 101 for a mug 201 according to the present application is illustrated. In this embodiment, adapter 101 further comprises one or more tabs 301 and one or more recessed portions 303 formed in the upper edge of adapter 101. Tabs 301 provide additional support in securing mug 201 in place within adapter 101 by extending radially inward over the upper edge of mug 201. Recessed portions 303 are preferably provided on either side of adapter 101 to provide the user with a more convenient means of drinking from mug 201. As depicted in FIG. 3, recessed portions 303 extend downwardly below the upper edge of mug 201. In this embodiment, mug 201 is secured into adapter 101, allowing the user to lift mug 201 and adapter 101 using handle 203 to drink from mug 201. This embodiment converts mug 201 into a "travel mug" that can be use with many types of cup holders 13. It will be appreciated that mug 201 may be held snuggly and securely within adapter 101 by other means. For example, insert 109 may be sized, shaped, and/or configured to hold mug 201 within adapter 101 with sufficient force to allow mug 201 and adapter 101 to be picked up as a single unit.

Figure 5:
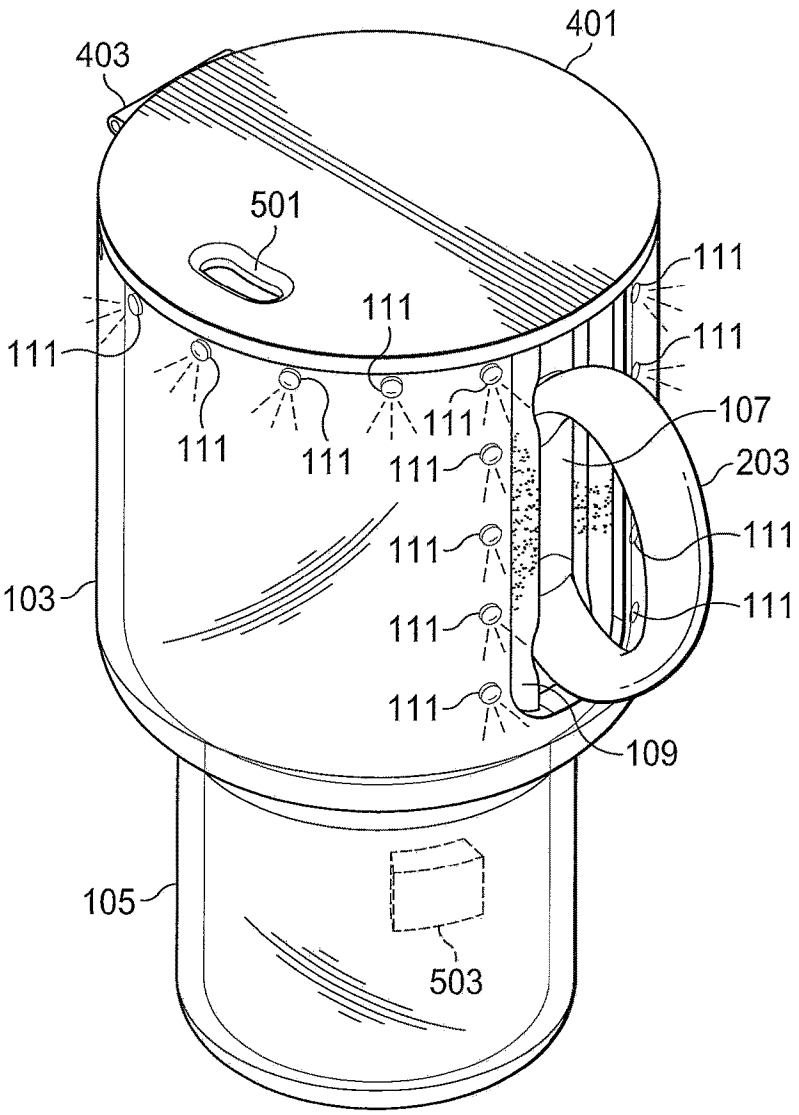
FIG. 5 is a perspective view of an alternative embodiment of a cup holder adapter for a mug according to the present application.

Referring now also to FIGS. 4 and 5 in the drawings, another alternative embodiment of cup holder adapter 101 according to the present application is illustrated. In this embodiment, adapter 101 includes a lid 401 that is releasably coupled to adapter 101 to prevent liquid within mug 201 from spilling out of mug 201, and/or provide additional insulation for mug 201. Lid 401 may be coupled to adapter 101 by various means, including a threaded attachment, a press fit attachment, a twist lock attachment, a hinged attachment, a tethered attachment, or any other suitable attachment mechanism. In the embodiments of FIGS. 4 and 5, lid 401 is coupled to adapter 101 via a connector, or hinge 403. In this embodiment, mug 201 can be secured into adapter 101 by inserts 109 and/or tabs 301. Alternatively, as is shown in FIG. 5, lid 401 can include a drinking port 501 to allow the user to drink from adapter 101 without having to remove lid 401. Drinking port 501 should be understood to embody any suitable shape and/or structure that facilitates drinking therethrough, including, for example, a small opening on the surface of lid 401, a raised opening in lid 401, or a depressed opening in lid 401. In the embodiment of FIG. 5, lid 401 preferably includes a seal between the inner surface of lid 401 and the upper edge of mug 201, so that liquid does not spill into the interior portion of adapter 101. A vent hole in lid 401 may also be used.

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

We claim:

1. An adapter for a cup holder, comprising:
a top section configured to hold a mug;
a generally vertical slot in the top section, the slot being configured to receive a handle of the mug;
at least one insert coupled to the vertical slot, the insert configured to fit snuggly around the handle of the mug for securely holding the mug in the top section; and
a bottom section configured for inserting into the cup holder.

2. The adapter according to claim 1, wherein the diameter of top section and the diameter of the bottom section are the same.

3. The adapter according to claim 1, further comprising:
at least one tab attached to the top of the adapter to secure the mug within the top section.

4. The adapter according to claim 3, further comprising:
a lip at the top of the adapter, the lip having at least one portion that extends downwardly below a top edge of the mug.

5. The adapter according to claim 1, further comprising:
a resilient insert disposed within the slot for retaining the mug within the top section.

6. The adapter according to claim 5, wherein the insert is formed from at least one of the following materials:
foam;
rubber; and
silicone.

7. The adapter according to claim 1, further comprising:
a lid releasably coupled to the adapter.

8. The adapter according to claim 7, further comprising:
a drinking port formed in the lid.

9. The adapter according to claim 1, further comprising:
a heating element at least partially disposed within walls of the adapter.

10. The adapter according to claim 9, wherein the heating element is rechargeable.

11. The adapter according to claim 1, further comprising:

a cooling element at least partially disposed within walls of the adapter.

12. The adapter according to claim 1, further comprising:

at least one lighting element coupled to the top section.

13. The adapter according to claim 12, wherein the at least one lighting element is an LED.

14. The adapter according to claim 13, wherein the LED is a multicolor LED.

15. The adapter according to claim 12, wherein the at least one lighting element comprises:

an arrangement of multiple lights.

16. The adapter according to claim 13, further comprising at least one of the following:

a lens cover disposed above the LED light;

a reflector disposed near the LED light; and a diffuser disposed near the LED light.

17. The adapter according to claim 1, further comprising:

a promotional indicia affixed to the adapter.

18. The adapter according to claim 17, wherein a portion of the top section is transparent, such that promotional indicia on the mug is visible through the top section.

19. The adapter according to claim 1, wherein the top section is at least one of the following:

hollow;

solid;

transparent; and translucent.

20. The adapter according to claim 19, further comprising:

a graphical indicia disposed between walls of the top section.

* * * * *